US006491483B1

(12) United States Patent
Ford

(10) Patent No.: US 6,491,483 B1
(45) Date of Patent: Dec. 10, 2002

(54) CARVING/PLANING ATTACHMENT FOR A ROTARY HAND TOOL

(75) Inventor: Albert J. Ford, Branson, MO (US)

(73) Assignee: S-B Power Tool Company, Chicago, IL (US)

( * ) Notice: Subject to any disclaimer, the term of this patent is extended or adjusted under 35 U.S.C. 154(b) by 32 days.

(21) Appl. No.: 09/642,295

(22) Filed: Aug. 18, 2000

(51) Int. Cl.[7] ..... B26D 1/12; B26B 11/00

(52) U.S. Cl. ..... 409/182; 407/54; 407/55; 7/158; 409/181

(58) Field of Search ..... 82/157, 161, 162, 82/128; 407/30, 54, 55; 409/181, 182, 288, 289, 301, 303, 308; 7/158, 167, 170

(56) References Cited

U.S. PATENT DOCUMENTS 4,357,817 A * 11/1982 Linsinger ..... 72/71
4,359,302 A 11/1982 Payne
4,674,548 A 6/1987 Mills et al.
5,224,230 A * 7/1993 Vanicsek et al. ..... 7/158
5,224,803 A * 7/1993 Lallier ..... 409/131
6,068,543 A * 5/2000 Renn ..... 451/67

FOREIGN PATENT DOCUMENTS

DE 954 737 12/1956
FR 2439651 5/1980

* cited by examiner

*Primary Examiner*—Henry Tsai
(74) *Attorney, Agent, or Firm*—Greer, Burns & Crain, Ltd.

(57) ABSTRACT

An attachment adapted to be mounted to the nose piece of the rotary tool or to the outer end of a flexible drive extension is disclosed. The attachment encircles the collet and bit at the base end portion of the attachment and has an extension portion that extends along the length of the bit and partially encircles it, providing a planar surface that limits the depth of engagement by the bit during operation. Also the extension has a semi-cylindrical surface portion that contacts a smooth outer end portion of the cutting bit and provides support to the bit so that it cannot be deflected and cut into the extension portion of the attachment. A recess in the back of the attachment is adapted to provide a surface into which the end of a user's thumb may rest for the purpose of applying downward force to the attachment during operation.

16 Claims, 3 Drawing Sheets

CARVING/PLANING ATTACHMENT FOR A ROTARY HAND TOOL

BACKGROUND

The present invention relates generally to a removable attachment for use with a rotary hand tool. More specifically, the present invention relates to a removable attachment which is adapted to be used for carving and/or planing tasks. The attachment is used in conjunction with an elongated drywall cutting bit or similar side cutting bit that is installed in the tool.

Various types of attachments are currently available for use with rotary hand tools (such as those marketed under the Dremel brand made by the S-B Power Tool Company of Chicago, Ill.) to aid the user in performing specialized tasks more accurately or more efficiently. Such attachments include various guide attachments for controlling the depth of cut and angle of penetration while performing various tasks that relate to making, maintaining and/or repairing objects or work surfaces.

Such rotary hand tools are often supplied with a flexible drive shaft that attaches to the nose portion of the hand tool itself and provides several feet of flexible extension with the bits being attached to the outer end of the extension. This enables the power unit to be suspended from a support and enables the user to control the bit rather than the power unit, which obviously is much lighter and enables more convenient usage in hard to access locations.

Manufacturers presently supply many different types of tool bits for use with such hand tools for performing tasks such as engraving, carving, polishing, cleaning, cutting, grinding, sharpening and sanding. Among the various types of cutting bits that are available are drywall cutting bits which generally have a number of flutes in the side thereof, with the end that is inserted into the collet being smooth and the cutting bit having a smooth outer end. The bits are approximately ⅛ inch in diameter and may be up to 2 inches in length. The elongated drywall cutting bit as well as other side cutting bits may conveniently be used to perform carving or planing tasks with the advantage that a relatively wide swath can be made because of the length of the cutting surface of the bit. However, the control of such cutting action is in large part a function of the skill of the user in that the amount of downward force applied to the bit during operation can vary the depth of cut. The cutting action can be quite irregular due to the variation in the softness of the material that is being worked on and the dexterity of the user.

Accordingly, it is a primary object of the present invention to provide an improved carving and/or planing attachment for a rotary hand tool which enables a user to easily remove material from a work piece in a controlled incremental basis.

Another object of the present invention is to provide such an attachment which enables the user to apply varying degrees of force to the bit without gouging the work piece to any significant degree regardless of the amount of force that is applied.

Still another object of the present invention is to provide such an attachment that is simple in its design and construction, comprises a unitary piece that is easily attached and is easy to use.

Yet another object of the present invention is to provide such an attachment that is adapted to be applied to the hand tool drive unit itself, or alternatively be attached to a flexible drive shaft extension or other attachment such as a right angle attachment.

Still another object of the present invention lies in the provision for applying substantial force to the drill bit without gouging in that the attachment prevents the bit from cutting more than a known predetermined amount during any one pass across the volume of the work piece.

These and other objects of the present invention will be apparent from the following detailed description of the invention, while referring to the attached drawings in which.

Figure 3:
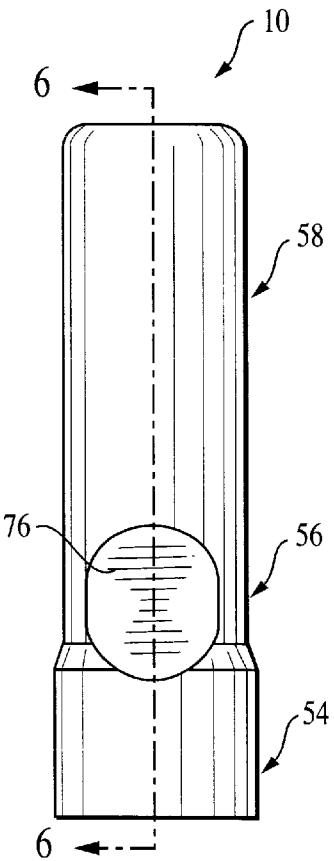
FIG. 3 is a plan view of the rear of the present invention.
Figure 2:
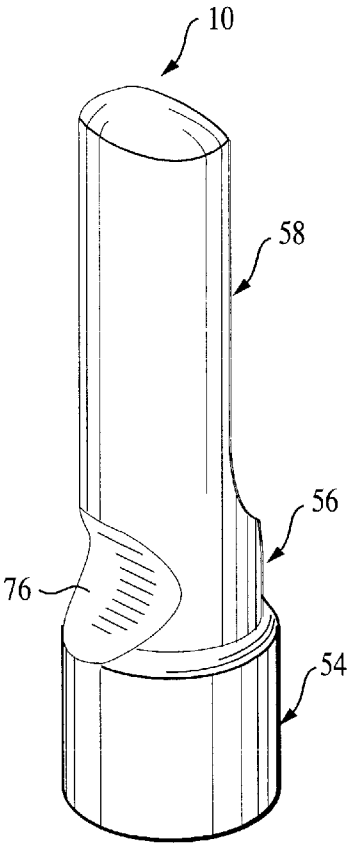
FIG. 2 is a perspective view of the left rear of the attachment embodying the present invention.
Figure 1:
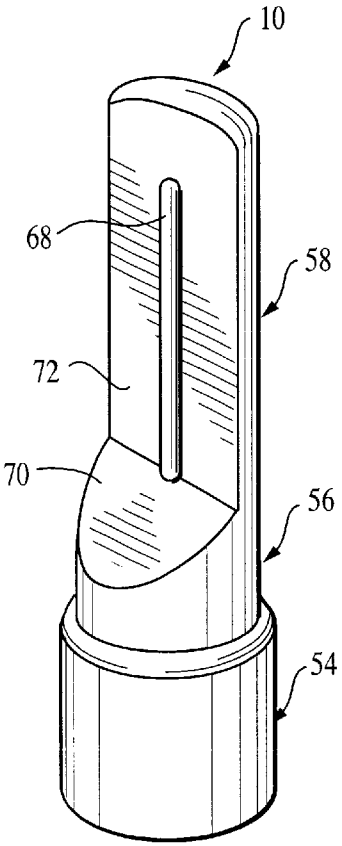
FIG. 1 is a perspective view of the right front of the attachment embodying the present invention.
Figure 6:
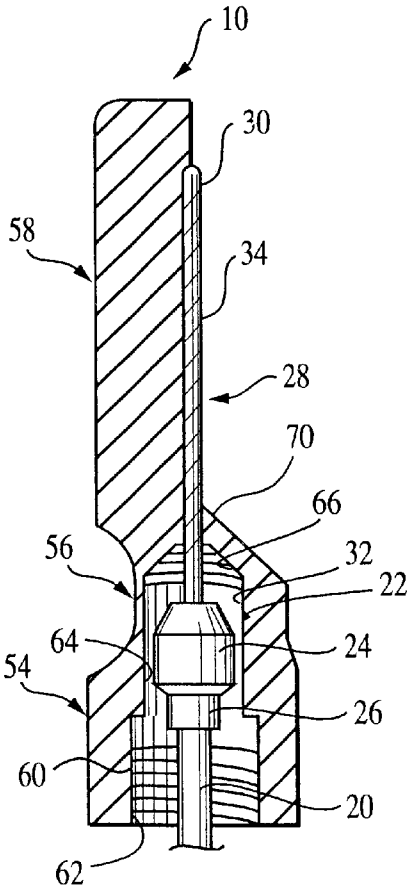
Figure 5:
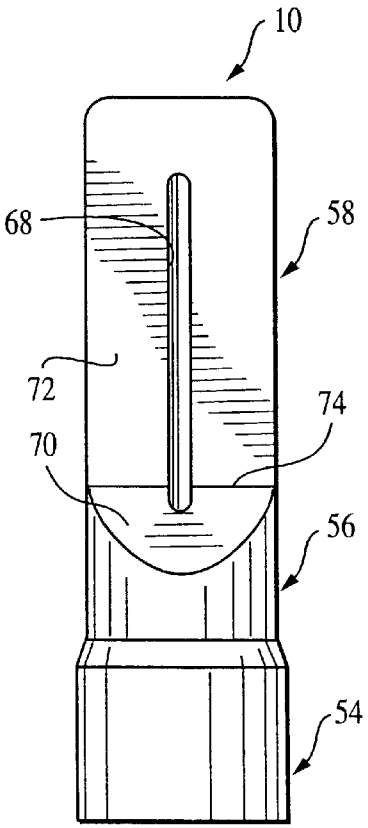
FIG. 5 is a front plan view of the attachment embodying the present invention.
Figure 7:
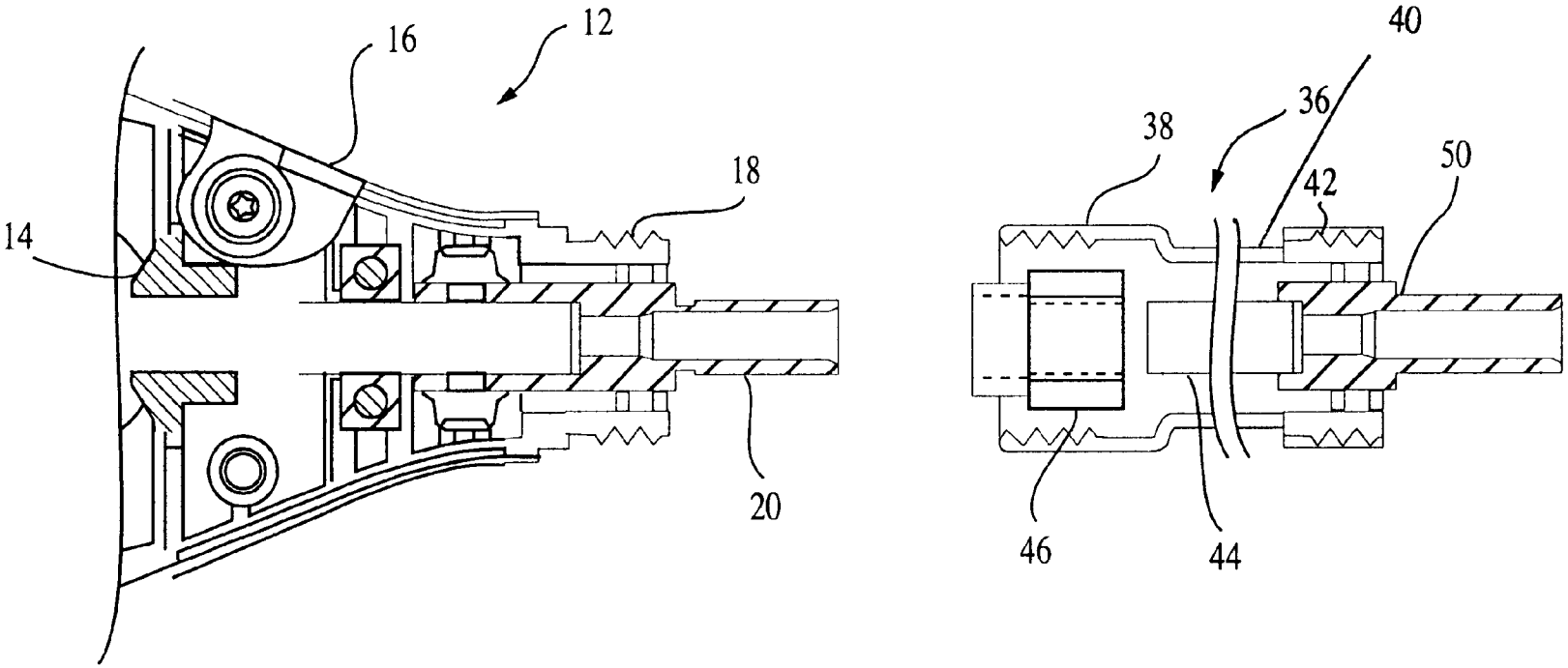

FIG. 6 is a sectional left side view taken along the line 6—6 of FIG. 3 shown together with a portion of the hand tool including a collet and bit; and FIG. 7 is a cross-section of a nose portion of a rotary hand tool to which the attachment of the present invention may be installed and is shown together with a side view of a flexible shaft extension that may be installed on the nose section of a rotary hand tool and to which the attachment embodying the present invention may be installed.

FIG. 8 is a cross-section of a nose portion of a rotary hand tool to which the attachment of the present invention may be installed and is shown together with a side view of a flexible shaft extension that may be installed on the nose section of a rotary hand tool and to which the attachment embodying the present invention may be installed.

DETAILED DESCRIPTION OF THE PREFERRED EMBODIMENT

Broadly stated, the present invention is directed to an attachment for a rotary hand tool of the type which has an electric motor that is relatively small in size and which has an output shaft or spindle to which a collet may be screwed on, with the collet being adapted to hold bits of various kinds for performing various tasks such as woodworking or other tasks such as polishing, grinding, sanding, cutting, and the like. The present invention is directed to an attachment for use in connection with a drywall cutting bit or other side cutting elongated bit which is used to carve or plane a work piece.

The carving and/or planing attachment is adapted to be mounted to the nose piece of the rotary tool or to the outer end of a flexible drive extension or any other suitable attachment such as a right angle attachment and encircles the collet and bit at the base end portion of the attachment. The carving and/or planing attachment embodying the present invention has an extension portion that extends along the length of the bit and partially encircles it, providing a planar surface that limits the depth of engagement by the bit during operation. Also the extension has a semi-cylindrical surface portion that contacts a smooth outer end portion of the cutting bit and provides support to the bit so that it cannot be deflected and cut into the extension portion of the attachment. A recess in the back of the attachment is adapted to provide a nonslip surface into which the end of a user's thumb may rest for the purpose of applying downward force to the attachment during operation.

Turning now to the drawings, the carving and/or planing attachment indicated generally at 10 is shown in FIGS. 1–6 and is adapted to be attached to a rotary hand tool indicated generally at 12 in FIG. 7 or to a flexible extension that may be attached to a threaded nose 18. The hand tool 12 has a motor 14, a housing 16, with the threaded nose 18 and an output spindle 20 that has a threaded portion onto which a collet 22 (FIG. 6) can be screwed on. The collet is of conventional design, having an outer nut 24 that is rotatably coupled to a stationary portion that is threaded onto the spindle 26 and contains a split ring collet which is sized to accept a predetermined sized bit, such as the bit indicated generally at 28 shown in FIG. 6. The bit 28 has a smooth outer end portion 30, a smooth shank 32 that fits within the collet 22, and a fluted side portion 34 located therebetween with the portion 34 being adapted to perform a cutting or planing action during operation. Such bits 28 are commercially available as drywall cutting bits, but other side cutting bits are also available.

As is known in the art, a drive means, such as a flexible shaft attachment as shown in FIG. 7 is available for connection to the hand tool 12, with the attachment generally indicated at 36 having a connector portion 38. The extension has a connector portion 38 which has internal threads that engage the threaded nosepiece 18 when installed and the connector portion is connected to an outer sheath 40 that terminates in a threaded attachment nose portion 42 that is similar in construction to the threaded nose portion 18. The attachment 36 has an internal flexible shaft 44 that is connected to the spindle via a keyed connector 46 with the connector being attached to the spindle 20 said having a keyed inner configuration that is complementary to the shape of the end of the shaft 44. The shaft 44 terminates in a spindle structure 50 which is threaded and of the same size as the spindle 20. Thus, a collet such as collet 22 can be attached to the spindle portion 50 and be adapted to retain a bit such as the bit 28 shown in FIG. 6. Other drive means, such as a right angle attachment, is available and similarly attaches to the nosepiece 18 and has an internal flexible shaft that is connected to the spindle and has an output spindle structure similar to structure 50 and has a housing to which the carving and/or planing attachment of the present invention can be attached.

With regard to the attachment 10 embodying the present invention, the attachment is preferably of unitary construction and may be made of metal, such as aluminum, steel or other metal, or it may be tirade of a plastic or plastic-like material. The attachment 10 has an overall cylindrical shape with a base portion indicated generally at 54, a transition portion indicated generally at 56 and an extension portion indicated generally at 58. However, it should be understood that the attachment may be made in two pieces with the transition and/or extension portion being rotatable relative to the base portion to vary the circumferential position of the cutting bit relative to the hand tool itself.

The base portion 54 is in the form of a hollow cylinder, with the inside of the cylinder being identified at 60 and having interior threads 62 which are adapted to engage the threaded nose portion 18 or the threaded nose portion 42 when installed on the rotary hand tool or an extension thereof. The interior 60 transitions to a chamber 64 that is cylindrical in shape and of a diameter sufficient to enable the collet 22 to be located therein, with the top of the chamber 64 having a conical shape 66 which transitions to an aperture 68 through which the bit 28 can pass. While the chamber of the preferred embodiment is shown to be closed, it should be understood that it need not be, i.e., there may be one or more openings in the side wall of the attachment adjacent the chamber. The aperture 68 continues to the extension portion 58 but becomes a semi-cylindrical aperture such as shown in FIG. and in the cross section of FIG. 6. The bit 28 is adapted to fit within the aperture 68 and its semi-cylindrical recess portion, with the extension portion providing support for the bit 28 during operation. This is achieved by the smooth non-cutting end portion 30 of the bit engaging the depth of the recess 68, with the material of the extension portion providing support for the bit during operation.

The transition portion 56 has an inclined face 70 extending from the outer diameter of the front inwardly toward the aperture 68 and terminating in a planar surface 72 at line 74 that approximately intercepts the center of the aperture 68 which necessarily corresponds to the center of the bit 28 as well. It should be understood that the attachment may be constructed so that the location of the planar surface 72 relative to the aperture may be different from that shown to expose more or less of the bit to a work piece. Thus, if the plane or surface 72 were more rightward relative to the bit as shown in FIG. 6. there would be less of the bit protruding from the plane or surface 72 which would reduce the possible depth of cut during use. Similarly, if the position of the plane or surface 72 were moved to the left relative to the bit so as to expose more of the bit, then the bit would be available to provide a deeper cut during a pass through the work piece.

The inclined portion 70 is shown to be approximately 45° and intercepts the plane of the area 72 at fine 74, which provides a guide for the user during operation. If a work piece is engaged by the surface 70 and the user applies force intending to bring the bit into engagement with the work piece, the inclined portion 70 will tend to position the attachment and tool relative to the workplace so that the cutting surface of the bit will engage the workplace approximately at the location of the line 74. It should be understood that the angle of the surface 70 may be greater or less than the approximate 45 degree angle shown and may in fact be curved if desired.

Figure 4:
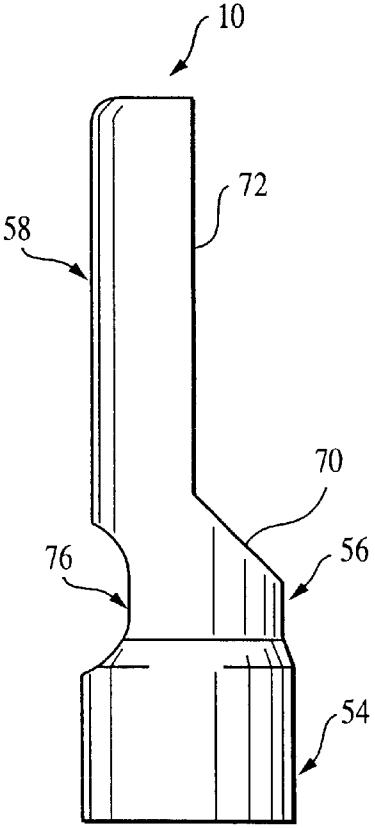
FIG. 4 is a plan view of the left side of the attachment embodying the present invention.

In order to apply pressure to the bit and attachment to increase the speed of cutting during operation, a recess 76 may be provided in the back of the attachment in the transition portion. It should be understood that the shape of the recess 56, while circular in shape from the side as shown in FIG. 4, may be some other curved shape and may in fact be planar if desired. The purpose of the recess is to provide a convenient surface where the user can apply force with his thumb or other portion of his hands to increase the speed of cut or otherwise more conveniently control the attachment.

From the foregoing, it should be appreciated and understood that an improved attachment for use with rotary hand tools has been shown and described which has significant attributes and advantages in carrying out carving and/or planing operations on a work piece in a manner whereby the potential of gouging the work piece is significantly minimized because of the presence of the extension portion of the attachment surrounding the cutting bit. The extension portion is adapted to contact the work piece and prevent the cutting bit from cutting deeper than a known amount. The size and shape of the attachment is conducive to highly efficient rapid and easy operation.

While a preferred embodiment of the present invention has been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the present invention are set forth in the following claims.

What is claimed is:

1. A carving and/or planing attachment for use with a rotary hand tool of the type which has an outer enclosure with a nose portion, a tool holder rotating about an axis and a bit mounted in the tool holder for engaging a work surface, the bit being of the type which has a long narrow cylindrical shape with an outer cutting surface for engaging a work piece, the cutting surface extending at least throughout a portion of the length of the bit, said attachment comprising:

a unitary structure having a base portion adapted to be mounted to the nose portion, a transition portion having a chamber in which the tool holder is located and an aperture through which the bit extends, and an extension portion that extends to at least the end of the bit and has a recess that surrounds a portion of the circumference of the bit.

2. A carving and/or planing attachment as defined in claim 1 wherein the tool holder comprises a collet.

3. A carving and/or planing attachment as defined in claim 1 wherein the bit has a smooth outer surface located at least at its outer end portion.

4. A carving and/or planing attachment as defined in claim 3 wherein the outer end portion of said extension portion has a semi-cylindrical surface for engaging the smooth outer surface of the bit for supporting the same and preventing the cutting surface from engaging the curved recess of said extension portion.

5. A carving and/or planing attachment as defined in claim 1 wherein the said extension portion has a planar surface that is adapted to limit the depth of cut of the bit into the work piece.

6. A carving and/or planing attachment as defined in claim 1 wherein the nose portion has external threads, said base portion being a generally hollow cylinder and having internal threads adapted to engage the external threads of the nose portion for threadably mounting said attachment to the nose portion.

7. A carving and/or planing attachment as defined in claim 6 wherein said chamber is generally cylindrical in shape and merges with the inside of said hollow cylinder of said base portion, said chamber being generally concentric with said aperture, said transition portion having a generally cylindrical shape with a first side having an inclined surface extending from the outer reach of said cylindrical shape to the approximate center thereof in the direction of said extension portion and intercepting said planar surface of said extension portion.

8. A carving and/or planing attachment as defined in claim 7 wherein said transition portion contains a outer surface recess on a second side opposite said first side.

9. A carving and/or planing attachment as defined in claim 8 wherein said depression is a generally curved depression that is adapted to receive the thumb of a user during operation of the hand tool with the attachment installed.

10. A carving and/or planing attachment as defined in claim 1 wherein said aperture has a circular cross section with a diameter slightly larger than the diameter of the bit.

11. A carving and/or planing attachment as defined in claim 1 wherein said extension portion has a generally semi-cylindrical shape and said curved recess is of a semi-cylindrical shape, the diameter of said curved semi-cylindrical shape being slightly larger than the diameter of the bit.

12. A carving and/or planing attachment as defined in claim 1 wherein said attachment is made of metal.

13. A carving and/or planing attachment as defined in claim 1 wherein said attachment is made of plastic.

14. A carving and/or planing attachment as defined in claim 1 wherein the plane of said planar surface approximately intercepts the center axis of the bit.

15. A carving and/or planing attachment for use with a rotary hand tool of the type which has an outer enclosure with a nose portion, a drive spindle extending from the nose portion, a drive means having first and second ends, the first end being connected to said drive spindle and the second end having a tool holder attached thereto, a bit mounted in the tool holder for engaging a work surface, the bit being of the type which has a long narrow cylindrical shape with an outer cutting surface for engaging a work piece, the cutting surface extending at least throughout a portion of the length of the bit between smooth exterior opposite end portions, said attachment being connected to the second end of the drive means, said attachment comprising:

a unitary structure having a base portion adapted to be mounted to the second end of the drive means, a transition portion having a chamber in which the tool holder is located and an aperture through which the bit extends, and an extension portion having a curved recess that surrounds a portion of the circumference of the bit, said extension portion having a planar surface that is adapted to limit the depth of cut of the bit into the work piece, the outer end portion of said extension portion having a semi-cylindrical surface for engaging the smooth outer surface of the outer end portion of the bit for supporting the same and preventing the cutting surface from engaging the curved recess of the extension portion.

16. An attachment as defined in claim 15 wherein said drive means is flexible and elongated and has first and second ends, with an internal drive cable contained within a drive sheath, the first end of the drive sheath being connected to the nose portion and the first end of the drive cable being connected to the drive spindle, a tool holder connected to the second end of said internal drive cable.

* * * * *

UNITED STATES PATENT AND TRADEMARK OFFICE

CERTIFICATE OF CORRECTION

PATENT NO. : 6,491,483 B1
DATED : December 10, 2002
INVENTOR(S) : Albert J. Ford It is certified that error appears in the above-identified patent and that said Letters Patent is hereby corrected as shown below:

Column 2,
Lines 28-33, delete in their entirety.

Column 4,
Line 2, after "FIG", first occurrence, insert -- 5 --.

Signed and Sealed this

Twenty-fourth Day of June, 2003

JAMES E. ROGAN
*Director of the United States Patent and Trademark Office*